US006715181B1

(12) United States Patent
Fries

(10) Patent No.: US 6,715,181 B1
(45) Date of Patent: Apr. 6, 2004

(54) HINGE DEVICE OF THE SNAP-IN TYPE

(75) Inventor: Bror Fries, Hishult (SE)

(73) Assignee: FRIP AB, Hishult (SE)

( * ) Notice: Subject to any disclaimer, the term of this patent is extended or adjusted under 35 U.S.C. 154(b) by 0 days.

(21) Appl. No.: 09/700,036

(22) PCT Filed: May 12, 1999

(86) PCT No.: PCT/NO99/00153

§ 371 (c)(1),
(2), (4) Date: Jan. 26, 2001

(87) PCT Pub. No.: WO99/61738

PCT Pub. Date: Dec. 2, 1999

(30) Foreign Application Priority Data

May 13, 1998 (NO) ..... 19982180

(51) Int. Cl.[7] ..... E05D 7/12

(52) U.S. Cl. ..... 16/271; 16/272; 16/240; 16/387

(58) Field of Search ..... 16/271, 272, 239, 16/240, 387

(56) References Cited

U.S. PATENT DOCUMENTS

| | | | | |
|---|---|---|---|---|
| 992,617 A | | 5/1911 | Varchmin et al. | |
| 2,940,115 A | | 6/1960 | Hansen | 16/131 |
| 4,185,357 A | | 1/1980 | Busse | 16/130 |
| 5,229,525 A | | 7/1993 | Petrov et al. | 548/959 |
| 5,339,493 A | | 8/1994 | MacIntyre | 16/238 |
| 5,694,665 A | * | 12/1997 | Strickland et al. | 16/238 |
| 5,713,105 A | * | 2/1998 | Toomey | 16/245 |
| 5,755,011 A | | 5/1998 | Green et al. | 16/238 |

FOREIGN PATENT DOCUMENTS

| | | |
|---|---|---|
| DE | 2460127 | 6/1976 |
| DE | 3311311 | 10/1984 |
| DE | 9202860 | 7/1992 |
| NO | 176683 | 1/1995 |
| WO | 98/22680 | 5/1998 |

* cited by examiner

*Primary Examiner*—Anthony Knight
*Assistant Examiner*—Doug Hutton
(74) *Attorney, Agent, or Firm*—Finnegan, Henderson, Farabow, Garrett, & Dunner, L.L.P.

(57) ABSTRACT

A hinge device of the snap-in type for use in a door leaf and door frame assembly, the hinge device having a first hinge leaf attachable to the door frame and second hinge leaf pivotably attached to said first hinge leaf and snap insertable into a receiving pocket on the door leaf. The second hinge leaf has a notch at its free end portion for interaction with an adjusting screw having a pair of step flanges to bear against either side of the second hinge leaf to enable lateral adjustment of the hinge device about hinge pivot means on the second hinge leaf, the pivot means being elevated protuberances at each lateral edge on both lateral surfaces of the second hinge leaf. Means are provided for also enabling height adjustment of the hinge device.

6 Claims, 7 Drawing Sheets

HINGE DEVICE OF THE SNAP-IN TYPE

BACKGROUND OF THE INVENTION

The present invention relates to a hinge device of the snap-in type for a door assembly comprising a door frame and a door leaf, wherein the hinge consists of two hinge leaves that are pivotal relative to one another via a pin joint, wherein one of the hinge leaves is capable of being secured to the door frame, wherein the other hinge leaf is designed for snap-in engagement with a receiving part which is fastened to the door leaf, the receiving part having a pin, boss or the like which is yielding on spring action and designed to snap into a hole or recess in the second hinge leaf, and wherein said first and second hinge leaves rest with their faces substantially parallel when the door assembly is in a closed position.

Hinges of the snap-in type for a door assembly have been on the market for many years and have largely replaced the traditional lift-off hinges in the case of lighter internal doors.

To compensate for skew hanging which occurs when there added tolerances in recesses and in hinges, and also non-perfect frame installation, a so-called hinge cracker is used to bend the hinge with force in a lateral direction. Insofar as vertical adjustment is concerned, this has hitherto been attended to by moving the hinge in the recess. In hinges of the lift-off type it has been possible, however, to adjust the height upwards with the aid of washers.

However, it has not been possible to adjust any of the previous hinges in the depthwise direction, which is desirable if the side parts of the frame have been placed somewhat out of line with one another.

The object of the present invention is to maintain the advantages that are present in a hinge of the snap-in type and allow the door leaf to be adjusted three-dimensionally by means of simple movements and the use of an ordinary screw driver.

As an example of prior art reference may be made, inter alia, to Norwegian Patent 147651 which relates to a solution partly for changing the swing direction of a door leaf and partly for adjusting the depth.

Norwegian Patent 161394 relates to a hinge comprising two hinge leaves, wherein one of the hinge leaves is made having a tongue-like portion intended for insertion into a groove in a mounting, which preferably is designed for recessing in the edge of a door leaf. To enable the hinge to be used both for right-hand hinging and left-hand hinging of a door without it having to be turned on its head, both the tongue-like portion and the groove are curved, the groove extending between two openings in the flat mounting which when installed faces outwards. The mounting consists of two parts that are displaceable relative to one another, and this permits adjustment of the hinge in the vertical direction in order to take up wear or compensate for production inaccuracies or skewness of the door frame.

Norwegian Patent 176683 relates to a laterally adjustable, insertable door hinge. The hinge fixing bracket at its mid-portion is formed having a pivot point about which the insertion tongue of the hinge can be tilted to a desired position, wherein the adjustment means for the insertion tongue is insertable at the side of the fixing bracket that is closest to the hinge shaft, wherein said adjustment means has grooves which, when the adjustment means is turned less than 180° in one direction or the other from a zero position, cause the insertion tongue to be tilted in a controlled manner in one direction or the other from a neutral position on the fixing bracket and secured in the desired position.

Norwegian Patent 165354 relates to a hinge wherein one of the hinge leaves is divided into two parts, one of which has a pocket into which the part fits. The shape and size of the pocket is such that the position of the part in the pocket can be adjusted by means of adjustable stops in the form of screws which are seated in the hinge leaf part for adjustment of a door leaf in an associated door frame. However, this hinge structure is not a hinge of the snap-in type, although lateral adjustment is made possible.

Danish Patent 138513 relates to a hinge of the insertion type. In this known solution, the insertion part of the hinge which is to enter a receiving part may have an optional depth of insertion in the pocket, whereby an adjustable depthwise adjustment of the hinge is obtained.

Swedish Patent Publication 427202 relates to a hinge having a hinge pin, wherein the two hinge parts are adjustable relative to one another, in that the hinge shaft is adjustable in its longitudinal direction and has an adjustable bottom stop. However, this known hinge is not of the snap-in type.

Norwegian Published Patent Application 147221 relates to a hinge wherein one of the hinge leaves can be hooked onto a fixing screw. However, this hinge cannot be adjusted in any way.

EP Publication 687787 relates to a hinge structure herein one of the hinge leaves is accommodated in a receiving part, and wherein the hinge can be adjusted sideways.

German Patent DE 2534472 relates to a hinge structure of the snap-in type, but which has no facilities for post-installation adjustments.

U.S. Pat. No. 2,885,722 relates to hinges for hanging doors wherein both depthwise adjustment and vertical adjustment are possible to a certain extent. However, the hinge is not of the snap-in type.

U.S. Pat. No. 4,185,357 relates to a hinge component wherein two adjusting screws are used to achieve best possible adjustment of one of the hinge leaves relative to a receiving part wherein this hinge leaf can be inserted.

U.S. Pat. No. 5,339,493 relates to a hinge wherein it is not possible to separate a receiving part and a hinge leaf inserted therein from one another, inasmuch as once the parts of the receiving part are joined together, the insertable hinge part can no longer be removed.

This hinge can be adjusted laterally and also vertically.

U.S. Pat. No. 5,694,665 relates to an adjustable hinge wherein it is possible, inter alia to adjust the hinge sideways.

One of the objects of the present invention is to turn to good account the advantages associated with a hinge structure of the snap-in type, and wherein the primary object is to provide a sideways adjustment of the hinge, whilst ensuring that depthwise adjustment and vertical adjustment can be easily made.

SUMMARY OF THE INVENTION

According to the invention, the hinge device is characterised in that pivot point means are provided either on the second hinge leaf or in a hinge leaf receiving pocket on the receiving part; that the second hinge leaf at the free end portion thereof is provided with a notch, and that the receiving part close to the pocket bottom has an adjusting screw having step flanges, wherein the adjusting screw upon the insertion of the second hinge leaf into the pocket enters the notch, and wherein the step flanges, having a diameter greater than the width of the notch, are designed to form abutment against opposing surface portions of the second hinge leaf, wherein turning the adjusting screw effects lateral adjustment of the hinge.

According to one embodiment of the device, the second hinge leaf has as pivot point means elevated protuberances at each lateral edge on both lateral surfaces of the hinge leaf, and the protuberances form respective abutment against the largest wall surfaces of the pocket, the protuberances also constituting stiffening of the hinge leaf.

The protuberances along respective lateral edges are offset relative to one another in the longitudinal direction of the hinge leaf and form an approximate wave shape.

According to another embodiment, the opposing, largest wall surfaces of the pocket at approximately the same depth in the pocket are each provided with a pair of elevated portions which extend into the pocket compartment and are intended for pivot point abutment against a respective lateral surface of the second hinge leaf.

According to yet another advantage of the present invention, the pin, boss or the like that is yielding on spring action is adjustably mounted with the aid of an adjusting screw in an elongate opening in an elastic tongue on the receiving part, whereby the possibility of depthwise adjustment of the hinge is obtained. The elastic tongue may optionally be an integrally cast part of the receiving part or may be secured to the receiving part. As an alternative, the pin, boss or the like that is yielding on spring action may be placed in a slide that is adjustable in the longitudinal direction of the pocket and is located in the receiving part, whereby the possibility of depthwise adjustment of the hinge is obtained.

To ensure that vertical adjustment of the hinge can be effected, the pocket of the receiving part has a width that is greater than the width of the lateral surfaces of the second hinge leaf, and a height that is greater than the thickness of the second hinge leaf, the receiving part along opposing lateral edges of the pocket having means for adjustable abutment against the opposing lateral edges of the second hinge leaf, whereby the possibility of vertical adjustment of the hinge is obtained.

According to yet another embodiment of the invention, the adjustable abutting means consist of a pair of adjusting screws or rotatable, spring-loaded, eccentric discs having a plurality of contact edge faces.

BRIEF DESCRIPTION OF THE DRAWINGS

The invention will now be described in more detail with reference to the attached drawings.

DETAILED DESCRIPTION OF THE INVENTION

Figure 1:
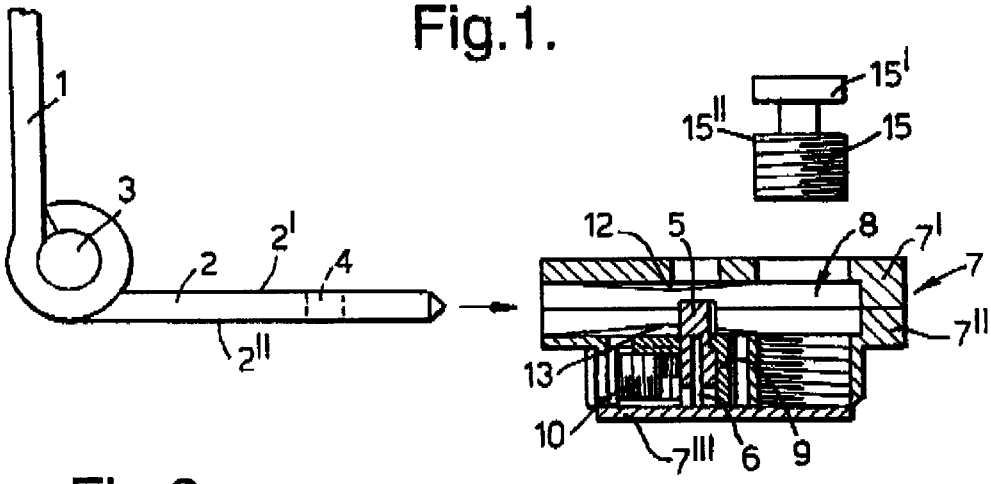
FIGS. 1–7 show a first embodiment of the device according to the invention.
Figure 2:
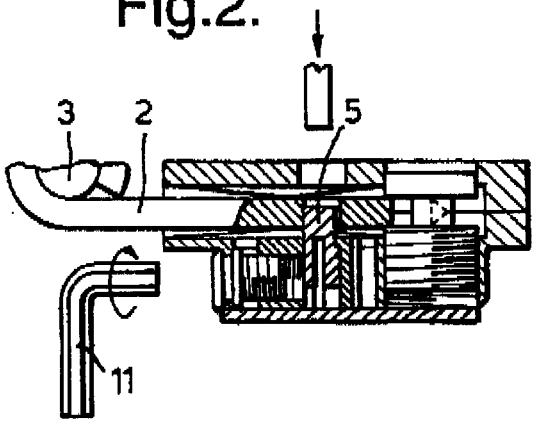
Figure 3:
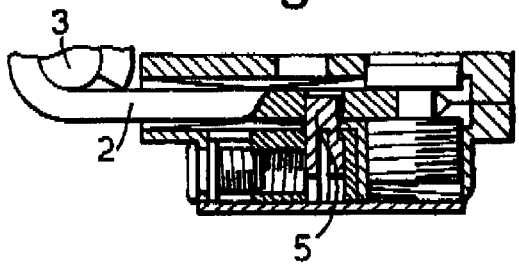
Figure 4:
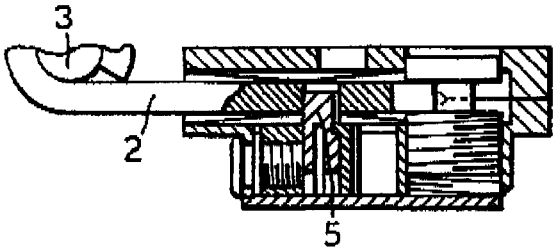

FIG. 1 shows two hinge leaves 1,2 that are pivotal relative to one another and which are pivotal via a pin joint 3. The hinge leaf 2 has a snap-in hole 4 which is designed to engage with a pin 5 which under the action of a spring 6 is yielding when the hinge leaf 2 is pushed into the pocket 8 of the receiving part 7. The pin 5 is mounted in a slide 9 capable of being moved to and from with the aid of an adjusting screw 10 which can be actuated by an adjusting tool 11. The to and from mobility of the pin 5 can be seen clearly from that illustrated in FIGS. 2–4.

In the hinge leaf receiving pocket 8 on the receiving part 7 there is provided on the opposing, largest wall surfaces of the pocket, and at approximately the same depth in the pocket a pair of elevated portions 12, 13 which extend into the pocket compartment 8 and are intended for pivot point abutment against a respective lateral surface 2', 2" of the hinge leaf 2. The hinge leaf 2 at the free end portion thereof is made having a notch 14. The receiving part 7 close to the bottom of the pocket 8 has an adjusting screw 15 with step flanges 15', 15", wherein the adjusting screw 15 upon insertion of the hinge leaf 2 into the pocket 8 enters the notch 14, and wherein the step flanges 15',15', having a diameter greater than the width of the notch 14 are designed to be capable of forming abutment against opposing surface portions 2', 2" of the hinge leaf 2, wherein turning the adjusting screw 15 will cause the free end portion of the hinge leaf 2 at the notch 14 to move upwards or downwards and tilt about the pivot points provided by the respective elevated portions 12, 13.

It will be appreciated that in this way the illustrated hinge device permits both lateral adjustment and depthwise adjustment.

Figure 6:
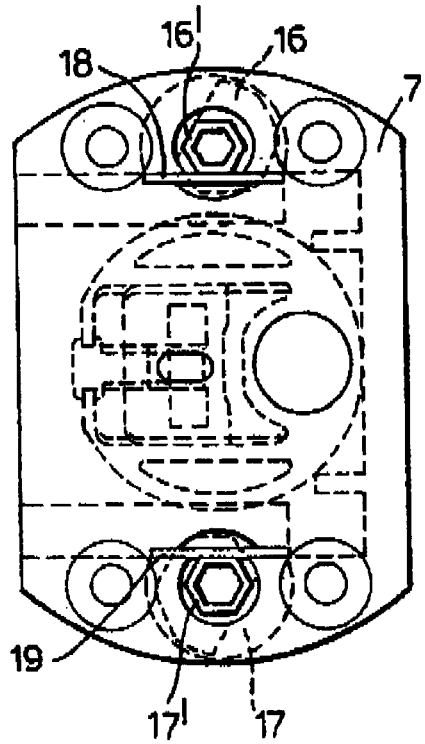

As indicated in FIG. 6, by allowing the pocket 8 of the receiving part to have a width that is greater than the width of the lateral surfaces of the hinge leaf 2 and a height that is greater than the thickness of the hinge leaf 2, it will be possible to make a vertical adjustment of the hinge leaf 2 relative to the receiving part 7. The receiving part 7 has adjustable abutting means 16, 17 consisting of rotatable, spring-loaded, eccentric discs 16, 17 having a plurality of contact edge faces. To maintain the eccentric discs in abutment against a respective lateral edge of the hinge leaf 2, the respective disc is made in one piece with a hexagonal sleeve 16', 17' intended for engagement with an Allen key. Springs 18, 19 will cause a surface of the hexagonal sleeve to be spring-loaded by respective springs 18, 19, so that the eccentric discs must be turned stepwise against the action from the respective spring 18, 19.

To cast and assemble the receiving part 7, it must normally be divided into two joinable parts 7', 7" and provided with a bottom cover 7'".

In the solution in FIGS. 8–13, the hinge is indicated by means of the reference numeral 20 and consists of a first hinge part 21 which is connected to a second hinge leaf 23 via a swivel 22. The hinge leaf 23 has an engagement hole 24 to allow engagement with an engaging boss 25 on the receiving part 26.

Figure 9:
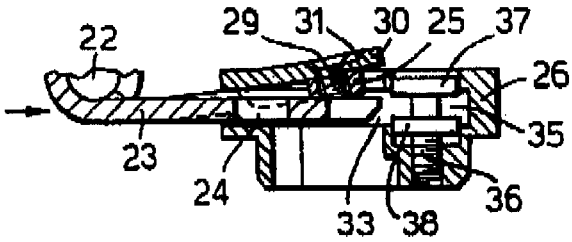
Figure 10:
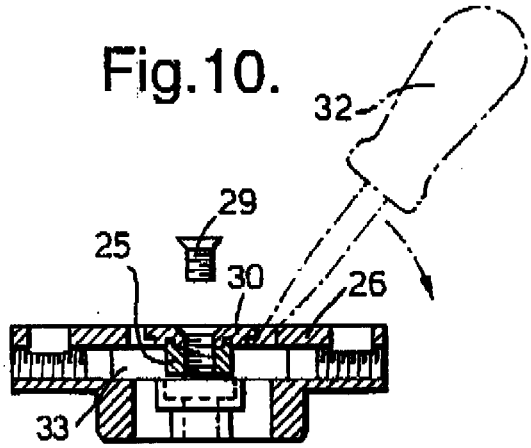
Figure 11:
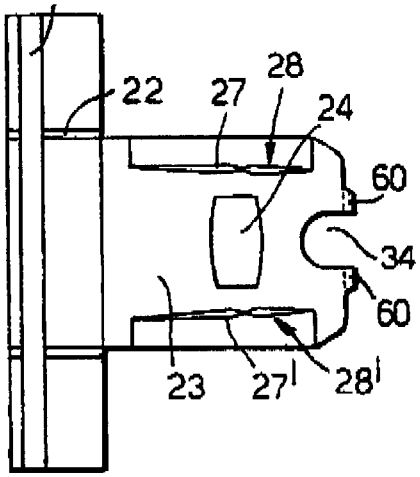
Figure 18:
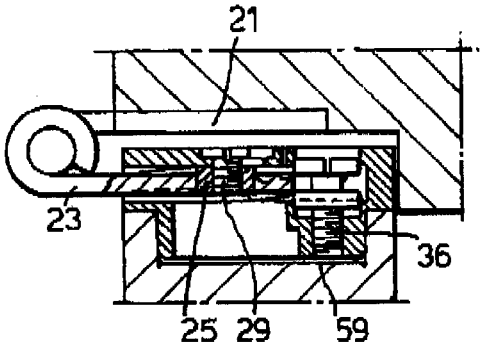
Figure 19:
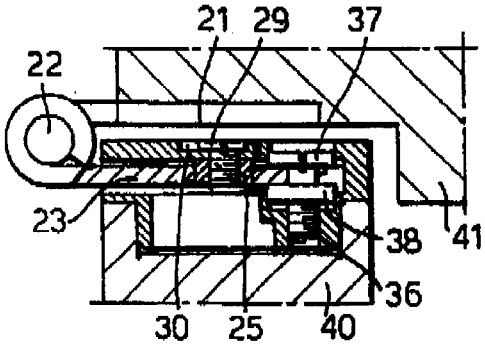

For the tilting function two pivot points 27, 28 are provided on the hinge leaf 23, on one side and the other side of the hinge leaf 23, respectively. As can be seen from FIG. 11, on opposing sides 23' and 23" there are provided pivot points 27, 28 in the form of elevated protuberances on each lateral surface, so that on the respective lateral surface 23', 23" of the hinge leaf there is a pair of such elevated protuberances 27, 27'; 28, 28'. The engaging boss 25 is releasably secured to an elastic tongue 30 which is an integrally cast part of the receiving part 26. The boss 25 is moveable relative to the elastic tongue 30, the head of the fixing screw 29 being adjustable along a groove 31 in the elastic tongue. By adjusting the position of the screw 29 relative to the groove 31, as is evident from FIGS. 18 and 19, it will be possible to make a depthwise adjustment of the hinge. If engagement between the boss 25 and the hole 24 in the hinge part 23 is required to be neutralised, the tongue 30 can be bent upwards using a tool, e.g., a screw driver, as shown in FIG. 10, and as also indicated in FIG. 9, whereby the hinge part 23 can be withdrawn from the insertion pocket 33 on the receiving part 26.

The tilting function of the hinge leaf 23 will be explained in more detail in connection with that illustrated in FIGS. 9, 11, 14 and 16, 17.

The protuberances 27, 27' and 28, 28' on the respective lateral surfaces of the hinge leaf are intended to form abutment against the opposing, largest wall surfaces of the pocket 33. The protuberances are made in the hinge leaf 23, preferably by a pressing or punching operation, so that the protuberances along the respective lateral edges are offset relative to one another in the longitudinal direction of the hinge leaf and form an approximate wave shape, as is clear from FIGS. 8, 16 and 17. By making the protuberances 27, 27', 28, 28' in this way, a considerable stiffening of the hinge leaf 23 is obtained simultaneously.

Figure 16:
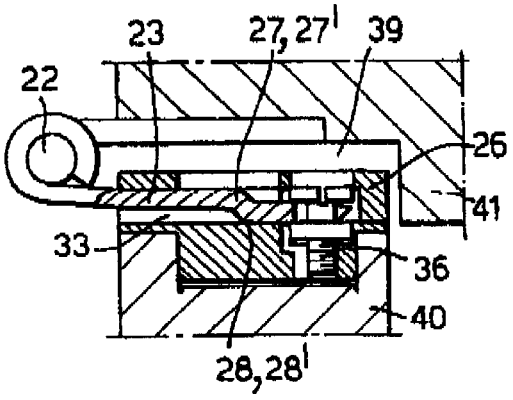
Figure 17:
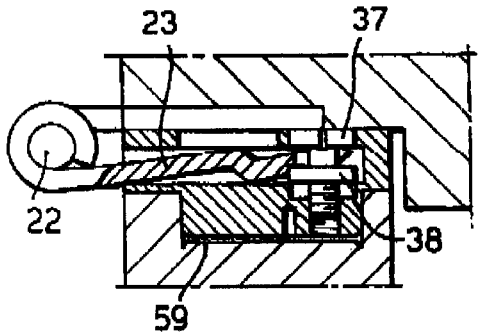

The hinge leaf 23 has in the free end portion thereof a notch 34 designed to enter the annular recess 35 on an adjusting screw 36 between its step flanges 37, 38. By manipulating with a tool 32, which could well be the same tool as that used for adjusting the screw 29 relative to the groove 31, the adjusting screw 36, together with its step flanges 37, 38, is moved upwards or downwards, depending on the direction of rotation of the tool 32. Thus, the hinge leaf 23 will tilt about the pivot points 27, 27', 28, 28', these pivot points or elevated protuberances forming an abutment against the opposing, largest wall surfaces of the pocket 33 in this embodiment of the device, the receiving part is not equipped with pivot point means. As can be seen in FIGS. 16 and 17, the adjustment of the screw in one direction or the other will effect a sideways adjustment of the hinge, thereby enabling the gap 39 between the door leaf 40 and the door frame 41 to be altered.

Figure 15:
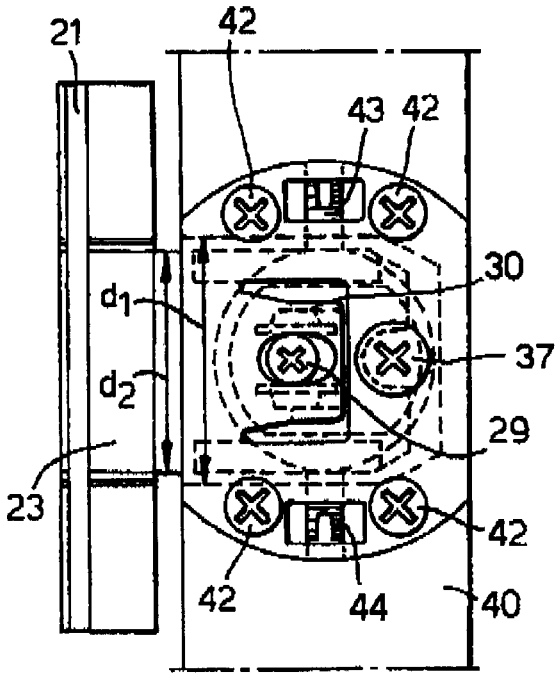

As shown in FIG. 15, the receiving part 26 is secured in a known way per se to the door leaf 40 by fixing screws 42.

Figure 7:
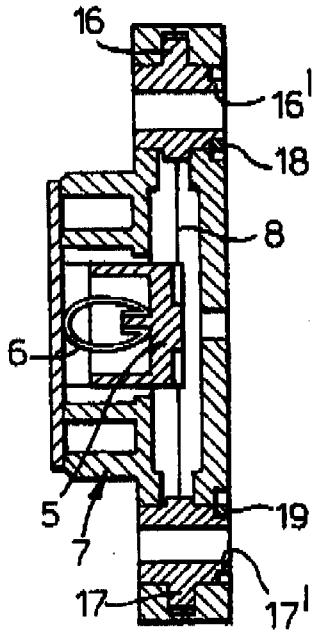
Figure 8:
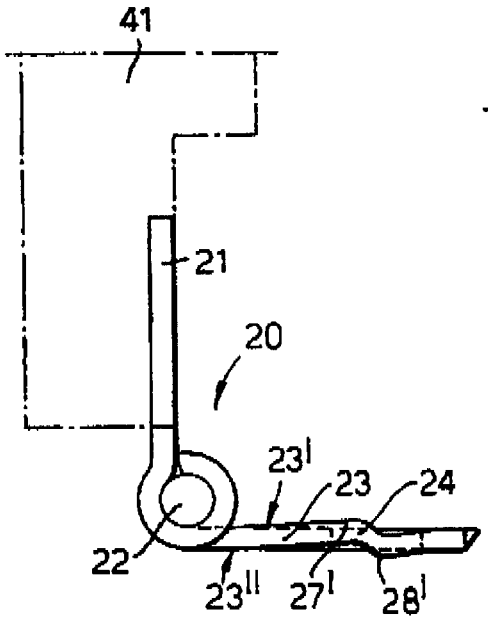
FIGS. 8–13 and 14–19 show a second embodiment of the device according to the invention.

In connection with FIGS. 6 and 7, there was a description of adjustable abutting means positioned along opposing lateral edges of the pocket for adjustable abutment against the opposing lateral edges of the hinge leaf, whereby the possibility of vertical adjustment of the hinge is achieved.

In the embodiment shown in FIG. 15, as an alternative to the embodiment in FIGS. 6 and 7, it is intended to provide the adjustable abutting means in the form of a pair of adjusting screws 43, 44. The width $d_1$ of the pocket 33 is greater than the distance $d_2$ between the lateral edges of the hinge leaf 23. This means that the hinge leaf has a certain movement potential in the vertical direction of the door assembly. To effect a vertical adjustment a coordinated adjustment of the adjusting screws 43 and 44 is made.

Figure 20:
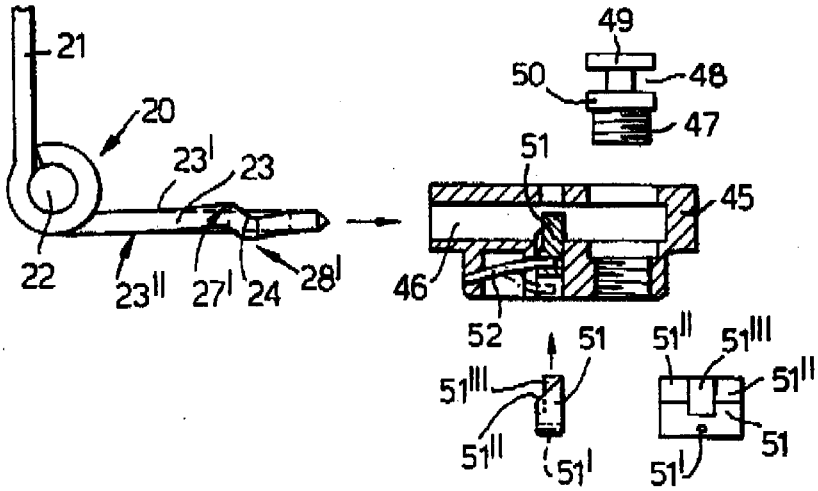
FIGS. 20–24 show a third embodiment of the device according to the invention.
Figure 21:
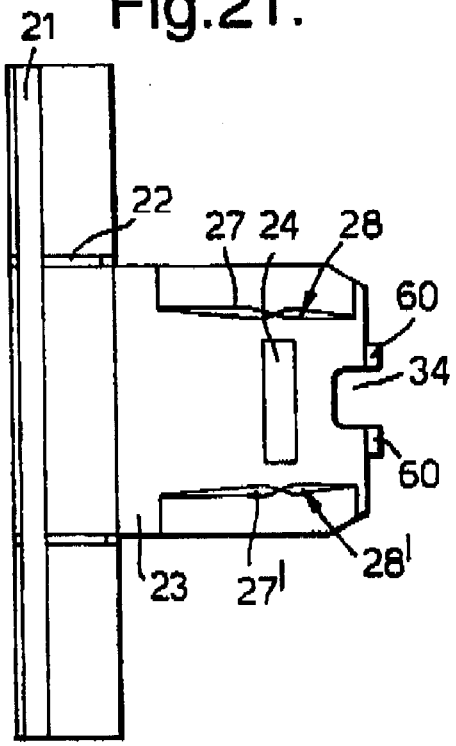

Another embodiment as shown in FIGS. 20–24 will now be explained in more detail. The hinge 20 with its two hinge leaves 21 and 23 has a design and mode of operation which essentially is as illustrated and described in connection with FIGS. 8 and 11 and will not be repeated here unless different from what has been illustrated and described in connection with the previous embodiments. In FIG. 20 the receiving part is indicated by means of reference numeral 45. The receiving part 45 has a pocket 46 for receiving the hinge leaf 23. The receiving part 45 close to the bottom of the pocket 46 has an adjusting screw 47 having annular groove 48 between step flanges 49, 50, as has also been described in connection with the previous embodiments. By moving the adjusting screw 47 one way or the other, the hinge leaf 23 will tilt about the pivot points 27, 27', 28, 28' which form abutment against the opposing largest wall surfaces of the pocket.

The solution for the receiving part 45 shown in FIG. 20 does not allow any depthwise adjustment of the hinge. In the receiving part 45 there is secured a pin 51 that is yielding on spring action and which is spring-actuated by a spring 52 installed in an opening in the body of the receiving part 45. The spring 52 may be, e.g., of leaf steel or made in the form of a spring wire. The spring 52 may be installed in the pin 51 in a hole 51' therein.

The vertical adjustment is effected in the same way as illustrated and described in connection with FIG. 12 and will not be explained in more detail here, the same adjusting screws 43, 44 being used.

In order to provide a downward movement of the pin 51 when the hinge leaf 23 is introduced, the pin 51 is provided with two inclined faces 51" which are actuated by bevelled pins 60 on the hinge leaf 23. Furthermore, the pin has a middle portion which is not bevelled and which with the top thereof forms a contact face for a tool (not illustrated) which can be pushed down through a hole 45' in the receiving part to release the engagement between the pin 51 and the hole 24.

The same solution applies to the embodiment in FIGS. 1–7.

In the case of the embodiments in FIGS. 8–19 and 25–28 the boss is shown to be bevelled to facilitate insertion of the hinge leaf. However, in these embodiments the spring is tilted upwards by a tool 32 in order to release the engagement between the boss and the hole in the hinge leaf.

Another embodiment of the device according to the invention, equipped with cast-in or attached elastic tongue, will now be described in connection with FIGS. 25–28. The embodiment has in terms of function the same mode of operation per se as that shown and described in connection with the receiving part shown in FIGS. 9, 10, 12, 13, 14–19.

Therefore, below there will simply follow a description of the structural differences without any detailed disclosure of the function.

In the embodiment as shown, inter alia, in FIG. 9, there is a spring 30 which is integrally cast with the material of the receiving part 26. This would be an appropriate solution when, e.g., plastics material is used for the receiving part 26. However, if it is intended to use metal, e.g., zinc, for the receiving part 53, it would not be appropriate to allow the spring to be of such a material. According to the invention, it is therefore proposed that there is provided as a spring material a spring 54 of spring steel which may have bent portions to provide sufficient stiffness and fastening flanges 54'. The spring 54 has an elongate hole 58 intended for receiving a fixing screw 55 which forms a threaded connection with a boss 56. A locking washer 57 is preferably also provided. Since the hole 58 is elongate, it will be appreciated that on appropriate adjustment and tightening, the position of the boss 56 relative to the longitudinal direction of the hinge leaf can be varied, thereby obtaining the possibility of depthwise adjustment of the hinge. The vertical adjustment of the hinge is effected as shown and described in connection with FIGS. 12, 15 and 22 and will not be elaborated upon here.

Figure 12:
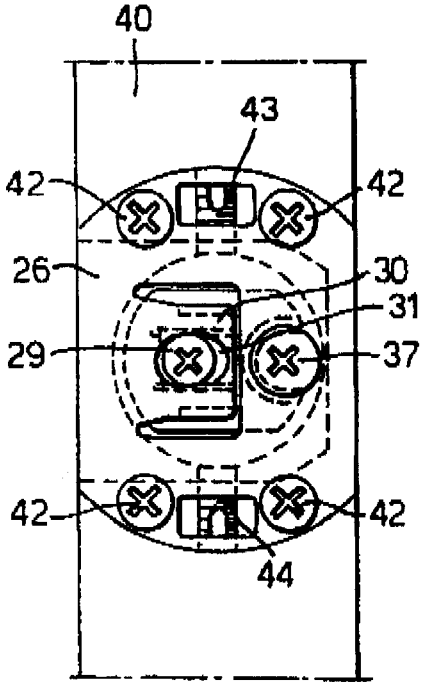
Figure 13:
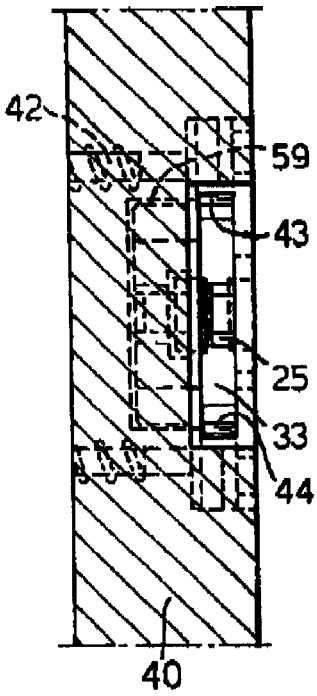
Figure 14:
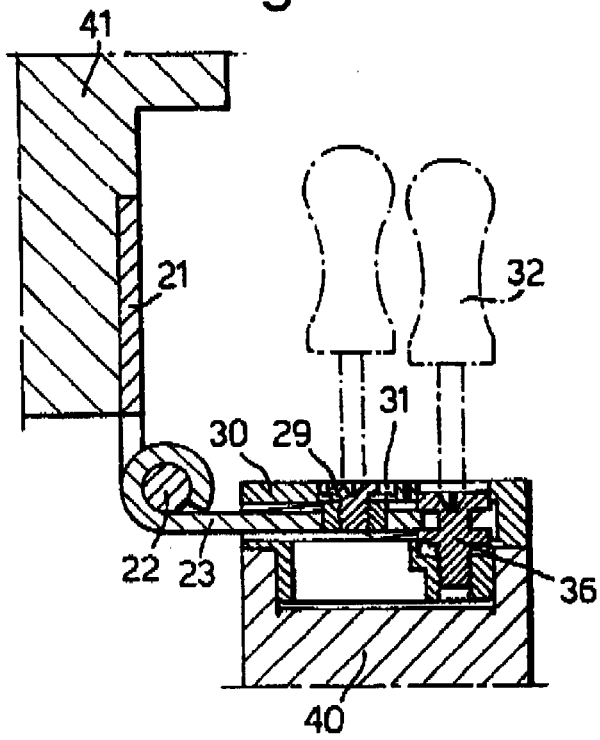
Figure 27:
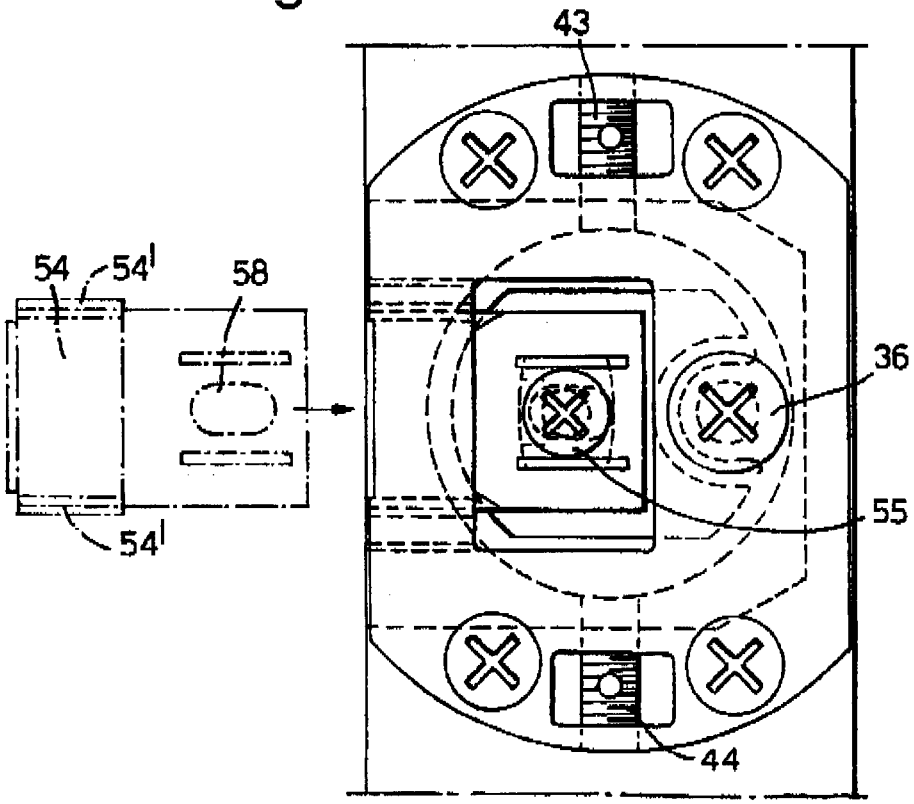

In FIGS. 12 and 15 and also FIG. 27 it is shown how the receiving part is fastened to a door leaf 40. As illustrated, the receiving part runs right out to the lateral edges of the door leaf 40. As can be seen in the figures (e.g., FIGS. 2, 7 and 9, 10), the receiving part is shown having two substantially cylindrical steps, so that the receiving part may optionally be turned 180° in a corresponding stepped recess 59 which is made in the door leaf 40. See FIGS. 17 and 18.

Figure 5:
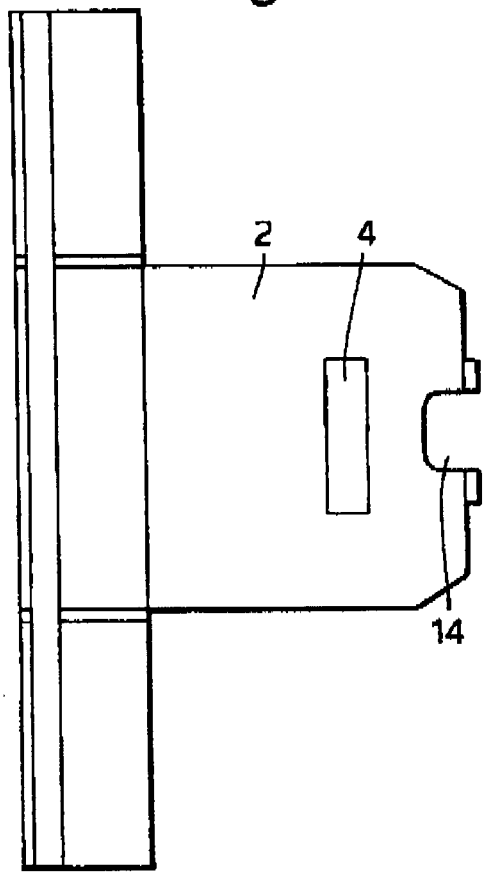
Figure 22:
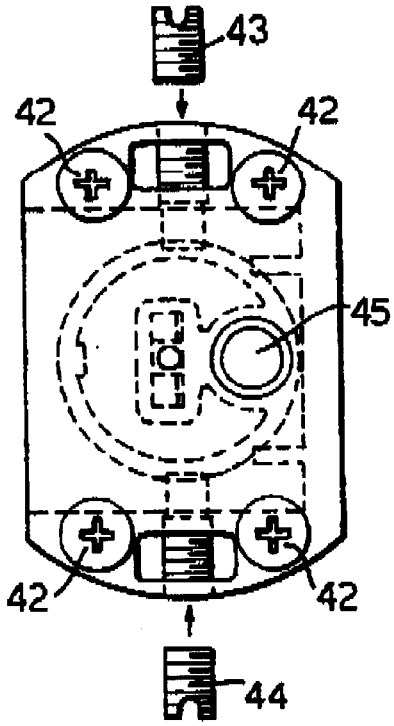
Figure 23:
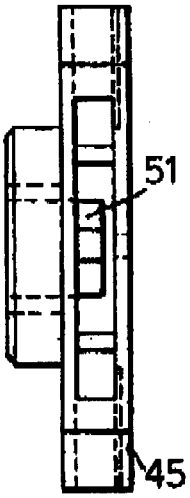
Figure 24:
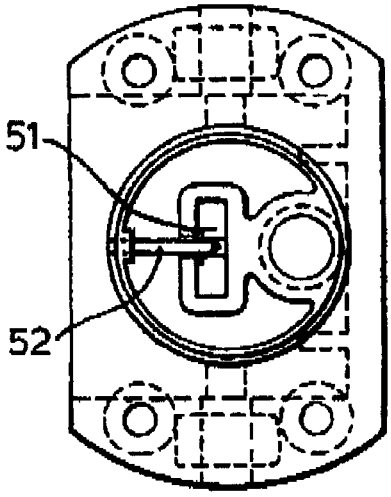
Figure 25:
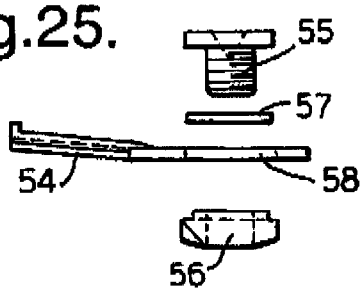
FIGS. 25–28 show a fourth embodiment of the device according to the invention.
Figure 28:
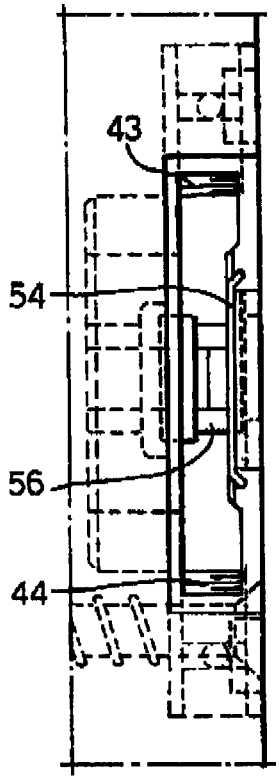
Figure 26:
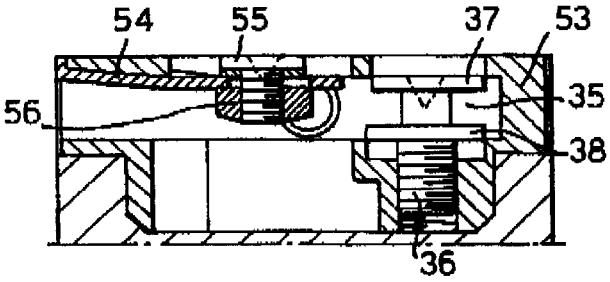

In order to allow vertical adjustment of the hinge, as shown for the embodiments of the hinge leaf illustrated inter alia in FIGS. 5 and 22, it is essential that the engagement hole 24 is elongate in the transverse direction of the hinge leaf. Thus, the pin or the boss which is elastically yielding can change position in the hole 24 as the hinge leaf is adjusted up or down in the receiving part.

It will also be understood that between the adjusting screw, e.g., the screw 15 in FIG. 1, 36 in FIG. 9 or 47 in FIG. 20, it is necessary to provide a certain clearance relative to the insertion part or the hinge leaf when this tilts as a consequence of the movement of the adjusting screw in one direction or the other. However, it is conceivable that the sides of the step flanges on the adjusting screw which face towards the surfaces of the hinge leaf are slightly bevelled, so that there is a minimum clearance.

When the hinge structure is to be used, for instance, in fire doors, it will not be appropriate to make the receiving part in plastic, but rather of metal instead, e.g., brass or zinc. In such a case it may, for example, be advantageous to use the solution outlined in connection with FIGS. 20–24 or FIGS. 25–28.

Other embodiments are of course conceivable within the scope of the invention.

What is claimed is:

1. A hinge device of the snap-in type for a door assembly having a door frame and a door leaf, the hinge device comprising two hinge leaves pivotal relative to one another via an articulated joint and a receiving part to be fastened to the door leaf, a first hinge leaf being capable of being secured to the door frame and the other, second hinge leaf being configured for snap-in engagement in a pocket of the receiving part, said second leaf hinge having opposed lateral surfaces, said receiving part having a pin or boss that yields on spring action and is configured to snap into a hole or recess in the second hinge leaf, said first and second hinge leaves resting with their surfaces substantially parallel when the door assembly is in a closed position, an adjustment screw located in the receiving part that cooperates with the second hinge leaf for lateral adjustment of the hinge device, elevated protuberances on each lateral edge of both lateral surfaces of the second hinge leaf that abut against opposing inner wall surfaces of the pocket when the second hinge leaf is received therein, said a protuberances stiffening the second hinge leaf, a notch on the second hinge leaf at a free end portion thereof, and step flanges on the adjustment screw located close to a bottom of the pocket, wherein upon insertion of the second hinge leaf into the pocket of the receiving part, the adjustment screw enters the notch on the second leaf hinge, said step flanges of the adjustment screw having a diameter greater than the width of the notch and capable of abutting against the opposed lateral surfaces of the second hinge leaf, whereby turning of the adjustment screw effects a lateral adjustment of the hinge device.

2. The hinge device of claim 1, wherein the protuberances along the lateral edges of the second hinge leaf are offset relative to one another in the longitudinal direction of the second hinge leaf and form an approximate wave shape.

3. A hinge device of the snap-in type for a door assembly having a door frame and a door leaf, the hinge device comprising two hinge leaves pivotal relative to one another via an articulated joint and a receiving part to be fastened to the door leaf, a first hinge leaf being capable of being secured to the door frame and the other, second hinge leaf being configured for snap-in engagement in a pocket of the receiving part, said second hinge leaf having opposed lateral surfaces, said receiving part having a pin or boss that yields on spring action and is configured to snap into a hole or recess in the second hinge leaf, said first and second hinge leaves resting with their surfaces substantially parallel when the door assembly is in a closed position, an adjustment screw located in the receiving part that cooperates with the second hinge leaf for lateral adjustment of the hinge device, pivot point means on the second hinge leaf, a notch on the second hinge leaf at a free end portion thereof, and step flanges on the adjustment screw located close to a bottom of the pocket, wherein upon insertion of the second hinge leaf into the pocket of the receiving part, the adjustment screw enters the notch, said step flanges of the adjustment screw having a diameter greater than the width of the notch and capable of abutting against the opposed lateral surfaces of the second hinge leaf, whereby turning of the adjustment screw effects a lateral adjustment of the hinge device and wherein the pin or boss that yields on spring action is adjustably mounted by a screw in an elongated opening in an elastic tongue on the receiving part to thereby provide for depthwise adjustment of the hinge device.

4. The hinge device of claim 3, wherein the elastic tongue is an integrally cast part of the receiving part.

5. The hinge device of claim 3, wherein the elastic tongue is secured to the receiving part.

6. A hinge device of the snap-in type for a door assembly having a door frame and a door leaf, the hinge device comprising two hinge leaves pivotal relative to one another via an articulated joint and a receiving part to be fastened to the door leaf, a first hinge leaf being capable of being secured to the door frame, and the other, second hinge leaf being configured for snap-in engagement in a pocket of the receiving part, said second hinge leaf having opposed lateral surfaces, said receiving part having a pin or boss that yields on spring action and is configured to snap into a hole or recess in the second hinge leaf, said first and second hinge leaves resting with their surfaces substantially parallel when the door assembly is in a closed position, an adjustment screw located in the receiving part that cooperates with the second hinge leaf, pivot means on the second hinge leaf, a notch on the second hinge leaf at a free end portion thereof, and step flanges on the adjustment screw located close to a bottom of the pocket, wherein upon insertion of the second hinge leaf into the pocket of the receiving part, the adjustment screw enters the notch, said step flanges of the adjustment screw having a diameter greater than the width of the notch and capable of abutting against the opposed surfaces of the second hinge leaf, whereby turning of the adjustment screw effects a lateral adjustment of the hinge device and wherein the pocket of the receiving part has a width that is greater than the width of the lateral surfaces of the second hinge leaf, and a height that is greater than the thickness of the second hinge leaf; and a pair of adjusting screws or rotatable, eccentric discs having a plurality of contact edge faces in the receiving part that abut against opposed lateral edges of the second hinge leaf, to thereby provide for vertical adjustment of the hinge device.

* * * * *

UNITED STATES PATENT AND TRADEMARK OFFICE

CERTIFICATE OF CORRECTION

PATENT NO. : 6,715,181 B1
DATED : April 6, 2004
INVENTOR(S) : Bror Fries

It is certified that error appears in the above-identified patent and that said Letters Patent is hereby corrected as shown below:

Title page,
Item [86], PCT Date, "Jan. 26, 2001" should read -- Nov. 9, 2000 --.

Column 7,
Line 51, "said a protuberances" should read -- said protuberances --.

Signed and Sealed this

Sixth Day of July, 2004

JON W. DUDAS
*Acting Director of the United States Patent and Trademark Office*